US009671164B2

(12) United States Patent
Forsyth et al.

(10) Patent No.: US 9,671,164 B2
(45) Date of Patent: Jun. 6, 2017

(54) SEED DRYER AND METHOD

(71) Applicant: Daniel L. Forsyth, Oelwein, IA (US)

(72) Inventors: Daniel L. Forsyth, Oelwein, IA (US); Greg St. Amour, Carmel, IN (US)

(73) Assignee: Daniel L. Forsyth, Oelwein, IA (US)

( * ) Notice: Subject to any disclaimer, the term of this patent is extended or adjusted under 35 U.S.C. 154(b) by 0 days.

(21) Appl. No.: 14/828,747

(22) Filed: Aug. 18, 2015

(65) Prior Publication Data

US 2016/0054059 A1 Feb. 25, 2016

Related U.S. Application Data

(60) Provisional application No. 62/039,735, filed on Aug. 20, 2014.

(51) Int. Cl.

| | |
|---|---|
| ***F26B 25/00*** | (2006.01) |
| ***F26B 3/08*** | (2006.01) |
| ***F26B 3/084*** | (2006.01) |
| ***F26B 3/10*** | (2006.01) |
| ***F26B 3/14*** | (2006.01) |
| ***F26B 17/10*** | (2006.01) |
| ***F26B 17/12*** | (2006.01) |

(52) U.S. Cl.

CPC ..... *F26B 3/08* (2013.01); *F26B 3/084* (2013.01); *F26B 3/10* (2013.01); *F26B 3/14* (2013.01); *F26B 17/101* (2013.01); *F26B 17/122* (2013.01); *F26B 2200/06* (2013.01)

(58) Field of Classification Search

CPC ..... F26B 19/00; F26B 21/00; F26B 23/00; F26B 25/00; F26B 3/08; F26B 3/084; F26B 3/10; F26B 17/101; F26B 17/122; F26B 2200/06

USPC ..... 34/86, 201, 210, 218; 165/104.16

See application file for complete search history.

(56) References Cited

U.S. PATENT DOCUMENTS

| | | | | | |
|---|---|---|---|---|---|
| 1,716,876 | A * | 6/1929 | Chamberlain | F26B 17/122 | 34/167 |
| 4,249,891 | A * | 2/1981 | Noyes | F26B 17/122 | 34/171 |
| 4,423,557 | A * | 1/1984 | Westelaken | F26B 25/002 | 34/167 |
| 5,561,916 | A * | 10/1996 | Willgohs | F26B 3/084 | 165/104.16 |
| 5,651,193 | A * | 7/1997 | Rhodes | F26B 25/009 | 34/531 |
| 5,950,325 | A * | 9/1999 | Mehdizadeh | F26B 3/343 | 219/701 |

(Continued)

FOREIGN PATENT DOCUMENTS

| | | | | |
|---|---|---|---|---|
| AR | EP 2803926 A2 * | 11/2014 | F26B 25/22 | |
| CN | WO 03031894 A1 * | 4/2003 | F26B 17/14 | |

(Continued)

*Primary Examiner* — Stephen M Gravini

(74) *Attorney, Agent, or Firm* — Shuttleworth & Ingersoll, PLC; Brett Papendick

(57) ABSTRACT

A system and method for at least partially drying seeds treated with a liquid. A supply of heated air is continuously fed to a drying chamber. Treated seeds enter one opening of the drying chamber and are forced around at least a portion of the internal perimeter of the drying chamber before exiting out a second opening. Another embodiment can treat the seeds during and/or after the seeds entering the drying chamber.

15 Claims, 7 Drawing Sheets

(56) References Cited

U.S. PATENT DOCUMENTS

| | | | | | |
|---|---|---|---|---|---|
| 6,122,838 | A * | 9/2000 | Bloemendaal | F26B 17/124 | 34/167 |
| 6,158,143 | A * | 12/2000 | Da Cunha | F26B 17/122 | 34/167 |
| 7,100,301 | B1 * | 9/2006 | Humphrey | F26B 23/028 | 34/174 |
| 7,380,348 | B2 * | 6/2008 | Seebach | B04C 3/00 | 34/326 |
| 8,161,663 | B2 * | 4/2012 | Weisselberg | C10L 9/083 | 202/109 |
| 8,356,420 | B2 * | 1/2013 | Morrison | F26B 17/124 | 209/134 |
| 8,590,174 | B2 * | 11/2013 | Rose | B08B 3/042 | 134/104.2 |
| 8,793,900 | B2 * | 8/2014 | Moretto | B29B 13/065 | 34/137 |
| 2008/0005922 | A1 * | 1/2008 | Kurashima | F26B 9/10 | 34/236 |
| 2014/0360045 | A1 * | 12/2014 | Bartosik | F26B 21/08 | 34/474 |
| 2015/0241123 | A1 * | 8/2015 | Morrison | F26B 17/12 | 34/86 |
| 2016/0054059 | A1 * | 2/2016 | Forsyth | F26B 3/08 | 34/594 |

FOREIGN PATENT DOCUMENTS

| | | | | | |
|---|---|---|---|---|---|
| FR | 2480920 | A2 * | 10/1981 | F26B 17/1416 | |
| GB | 191029824 | A * | 0/1911 | F26B 17/16 | |
| GB | 141468 | A * | 4/1920 | F26B 17/126 | |
| IE | GB 2405192 | A * | 2/2005 | C12C 1/073 | |
| IT | FR 2608380 | A3 * | 6/1988 | A23B 5/02 | |

* cited by examiner

SEED DRYER AND METHOD

CROSS-REFERENCE TO RELATED APPLICATIONS

The present application claims priority to provisional patent application 62/039,735 which was filed on Aug. 20, 2014, and is hereby expressly incorporated by reference in its entirety.

BACKGROUND OF THE INVENTION

In the agricultural industry, the treatment of seeds with various chemicals prior to planting is utilized to increase the likelihood of producing a successful plant. The treatment can include use of a liquid as a carrier. The liquid can present its own problems such as clumping and the partial blocking of absorption of chemicals into the seed.

It is therefore an object of the invention to provide a drying system and method to efficiently dry the seeds.

It is further the objection of the invention to provide a drying system and method to dry seeds in a limited amount of space.

SUMMARY OF THE INVENTION

The drying system of the invention utilizes forced, heated air through a drying chamber containing seeds that have been recently treated with a liquid application. The drying chamber is a dual chamber with a series of deflectors that assist in directing the seed through the drying chamber. The seeds enter through an inlet in the chamber and exit through an opening in the bottom of the chamber. After the seeds exit, they fall on a conveyor system which transports the seeds to a storage container. Another embodiment of the system foregoes the treatment of seed until after exiting the chamber.

The system is sized such that it does not occupy a large footprint and the amount of heat is adjustable depending on the conditions of the location of the invention. Variables such as air flow and the rate of seeds added to the chamber can be changed depending on the particular application.

DESCRIPTION OF THE PREFERRED EMBODIMENT OF THE INVENTION

Figure 7:
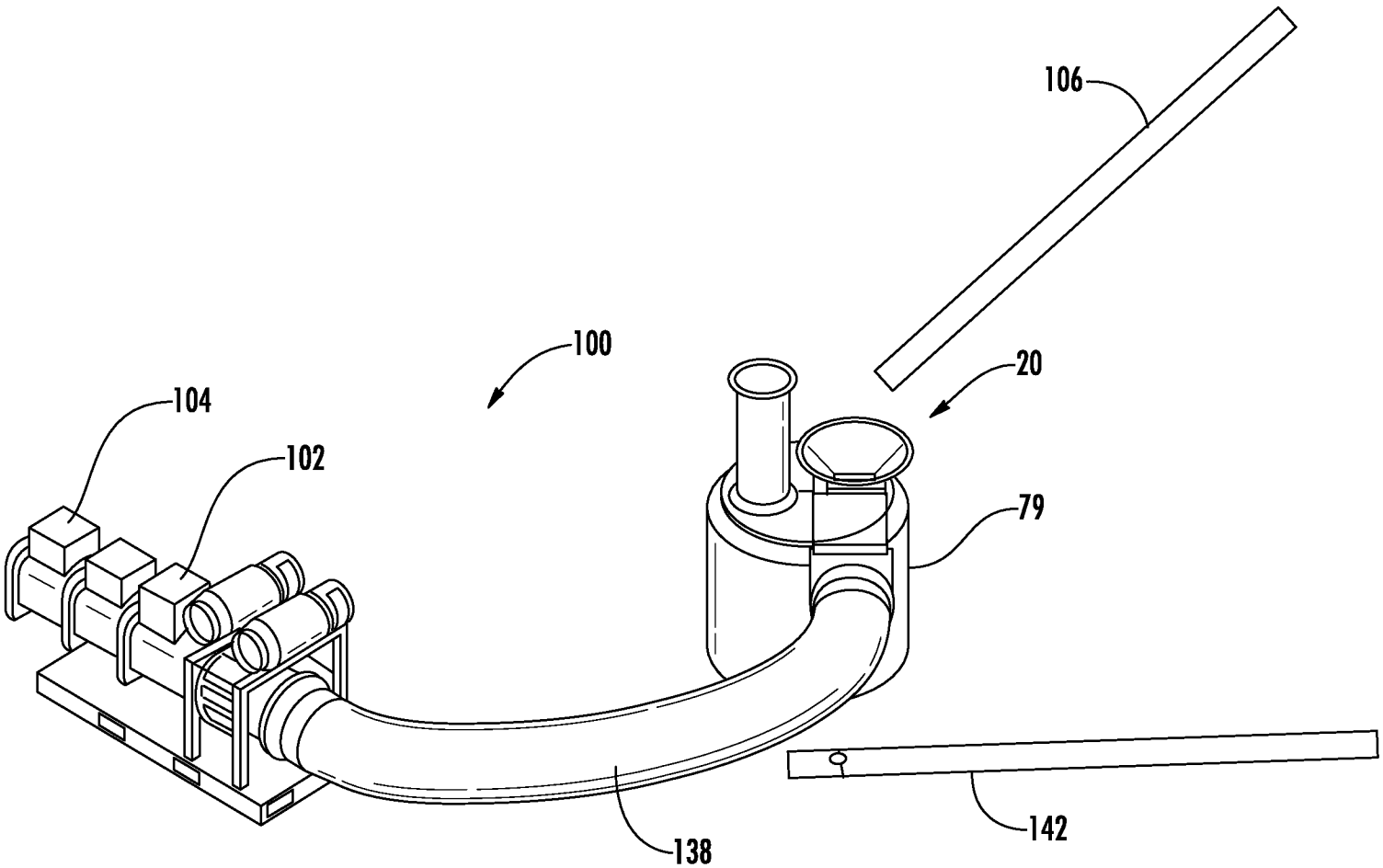
FIG. 7 is a perspective view of the chamber with a dryer and conveyor system attached.

Referring first to FIGS. 1-4, a drying chamber 20 is shown. The drying chamber 20 comprises a first chamber 22 and a second chamber 24. Preferably the first chamber 22 is atop the second chamber 24 in order to minimize the footprint of the drying chamber 20. The drying chamber has an air intake 26, a hopper 27, and a vent 28. The air intake 26 allows air at a predetermined temperature to enter the drying chamber 20. The hopper 27 allows seeds or other materials to enter the drying chamber 20. The vent 28 allows a portion of moisture laden air to exit the drying chamber 20. In addition to the vent 28, air exits the chamber through a vented chamber screen 30 and the discharge outlet 32. As shown in FIG. 7, the drying chamber 20 is part of drying system 100. The system 100 utilizes a heater 102, a blower 104, and a conveyor 106 to continuously dry a supply of seeds.

Figure 1:
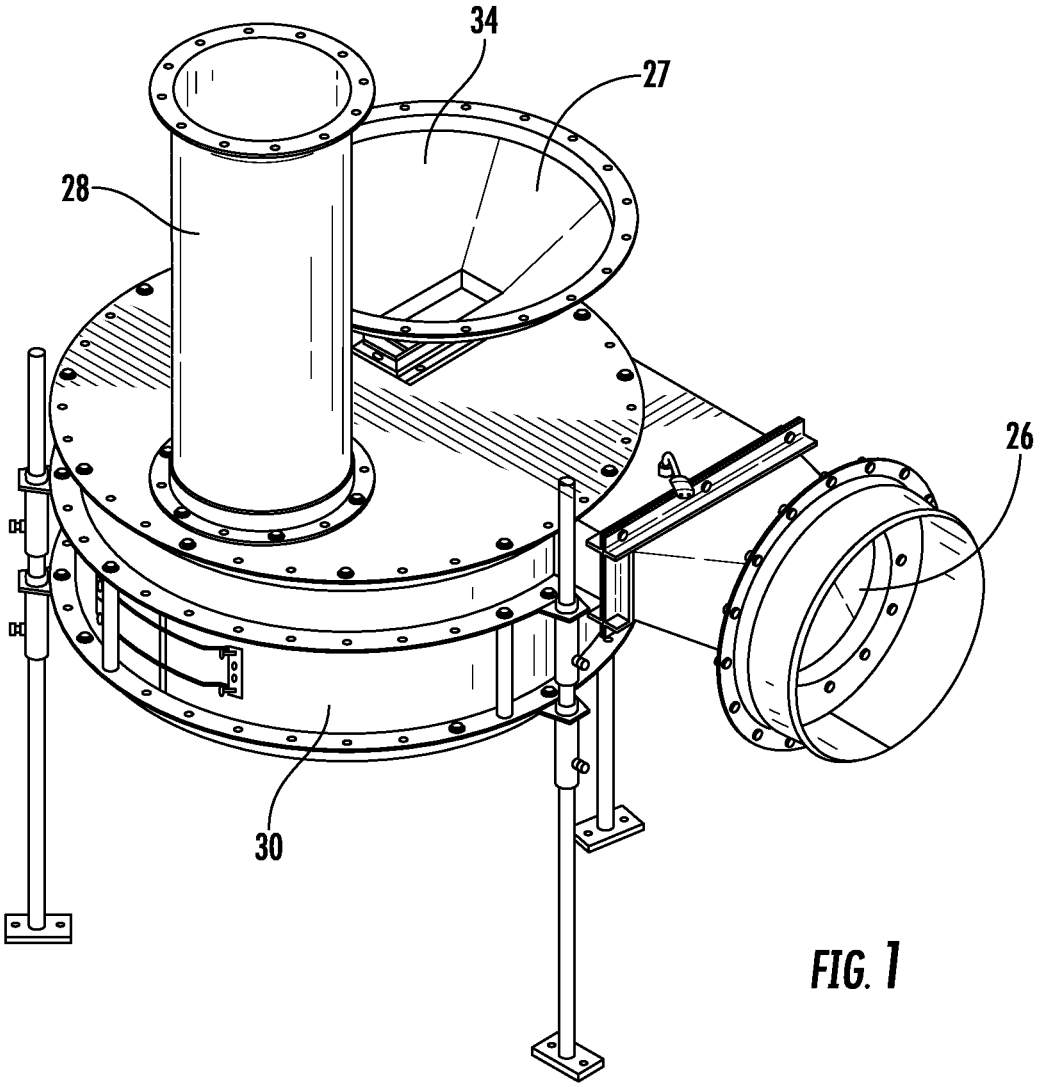
FIG. 1 is a perspective view of the drying chamber.
Figure 2:
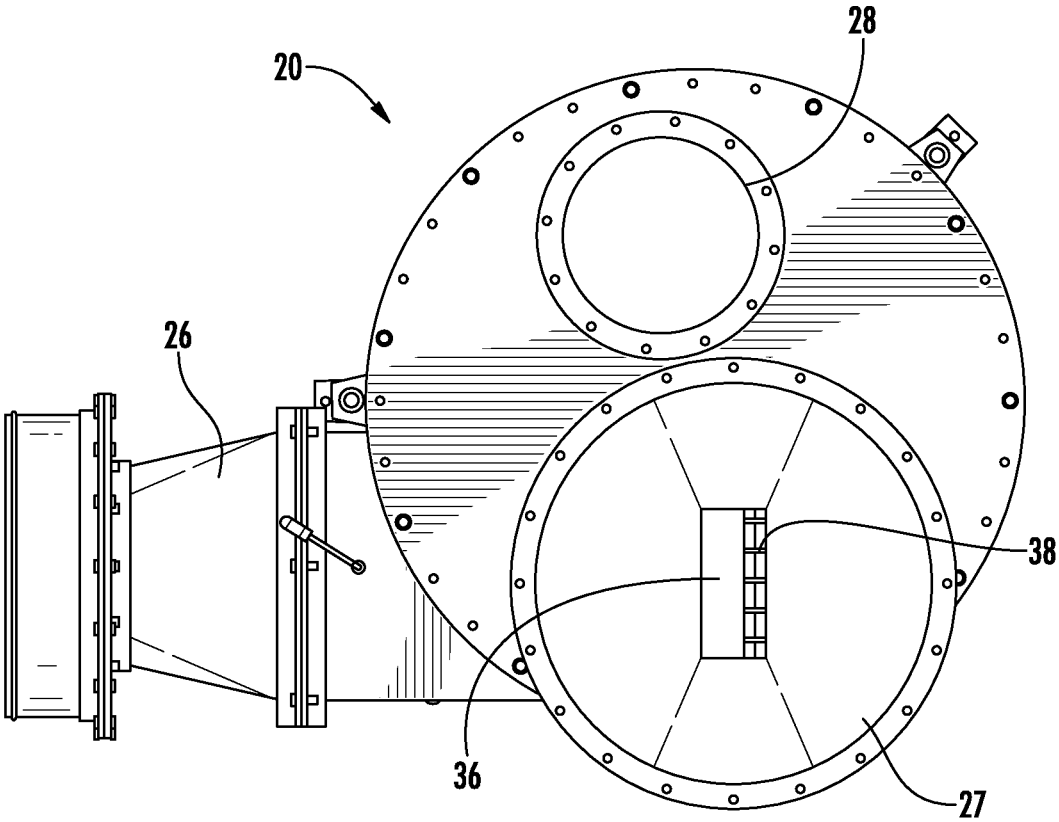
FIG. 2 is a top view of the chamber.
Figure 3:
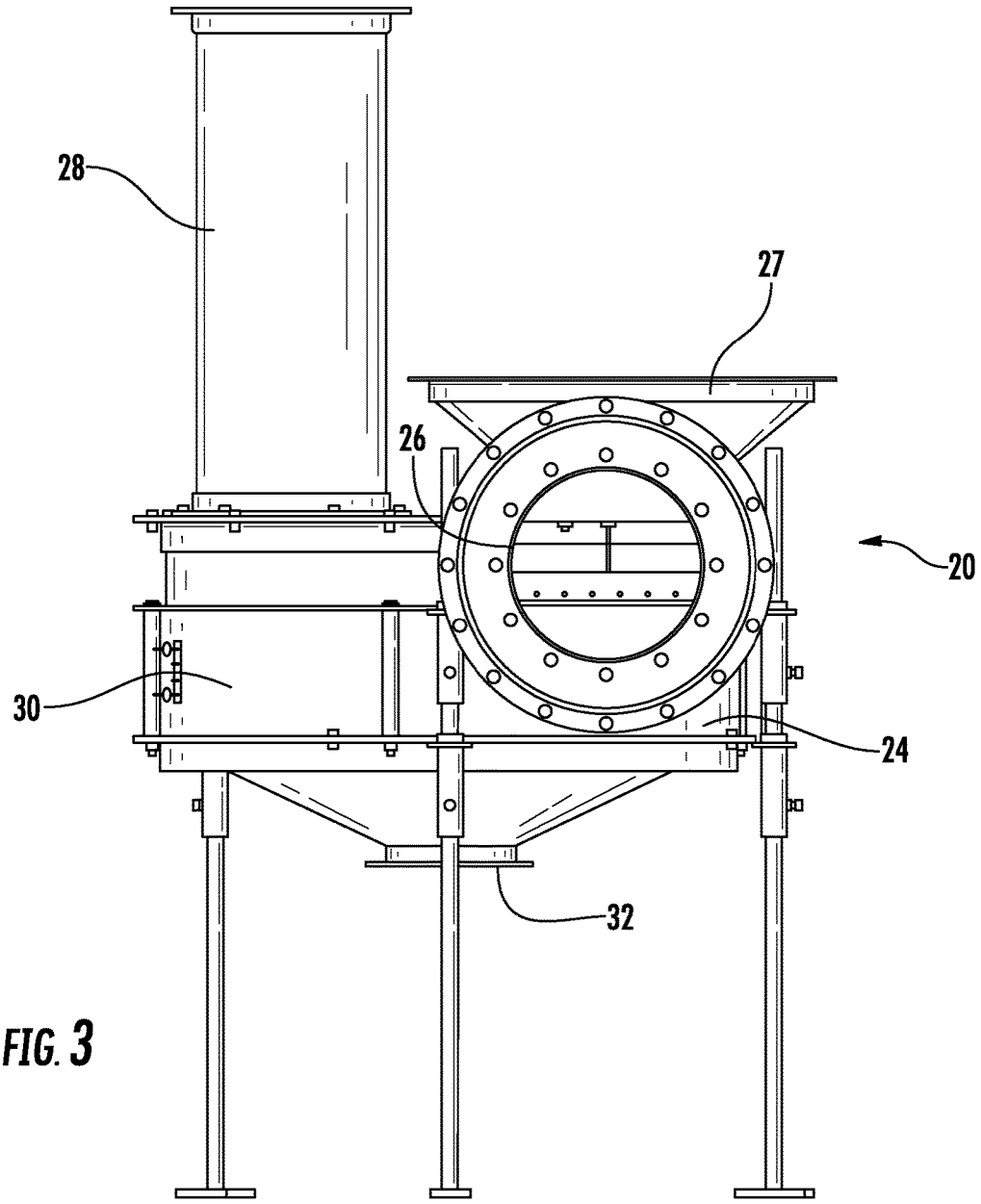
FIG. 3 is a front view of the chamber.
Figure 4:
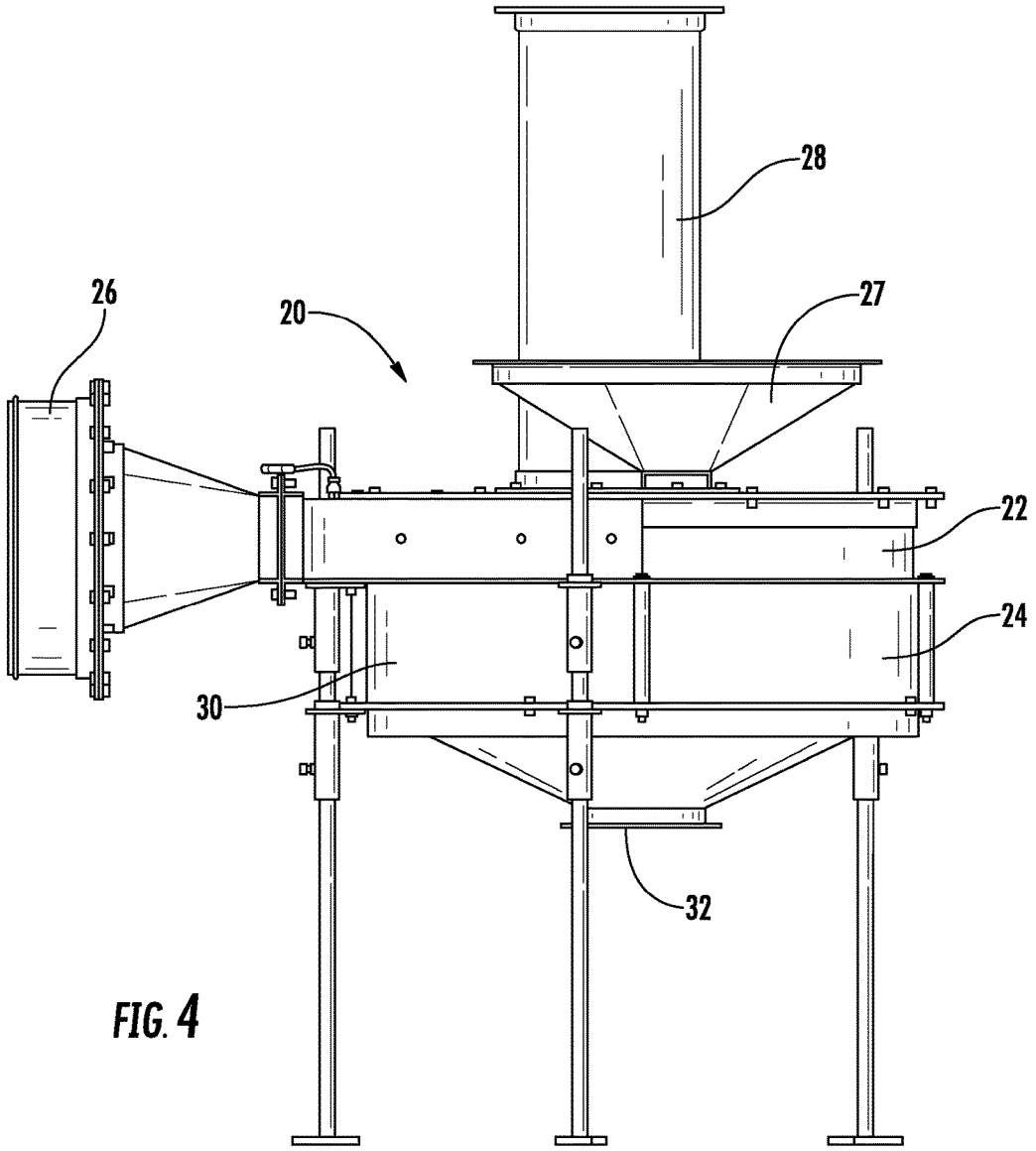
FIG. 4 is a side view of the chamber.
Figure 5:
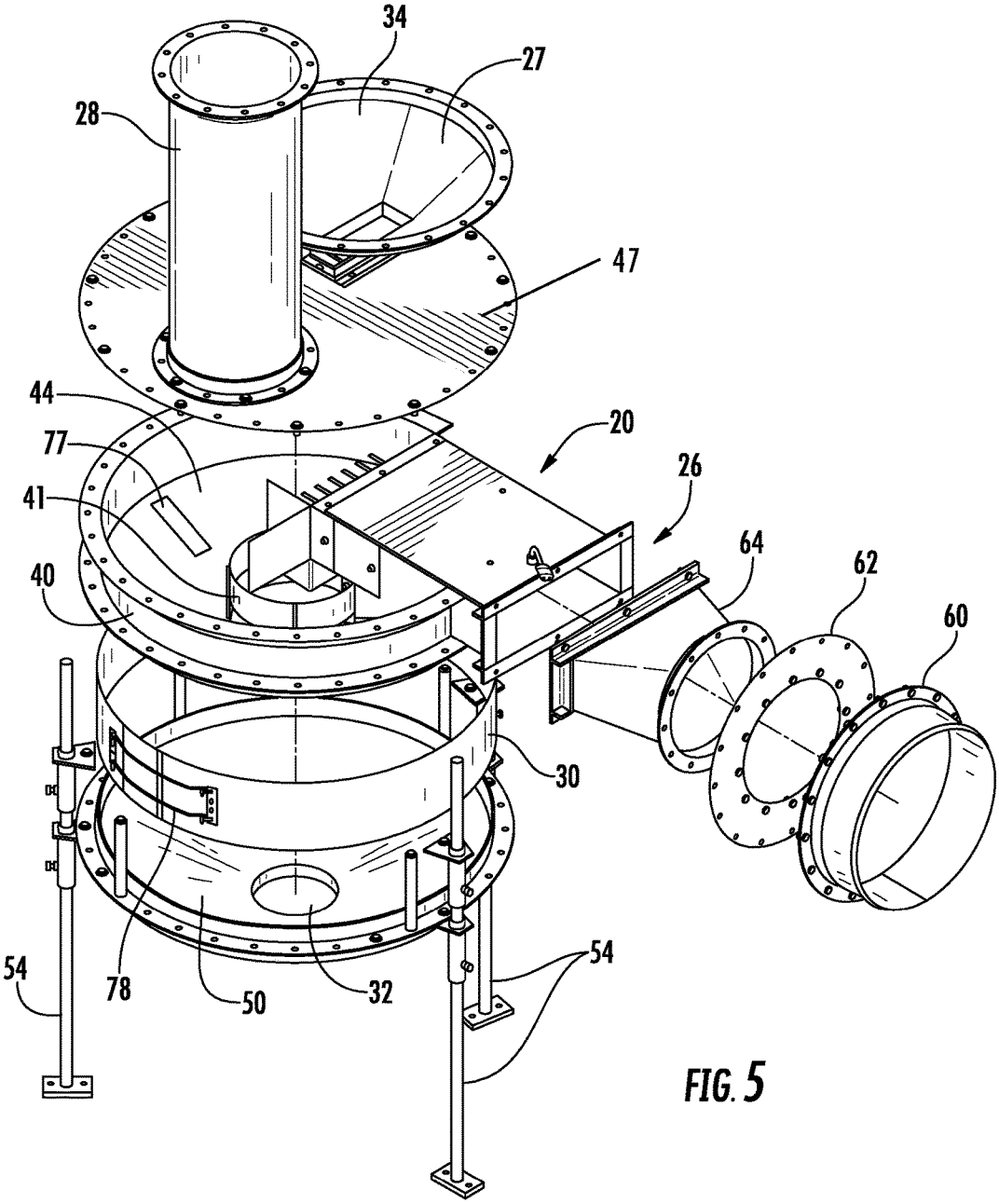
FIG. 5 is an exploded view of the chamber.
Figure 6:
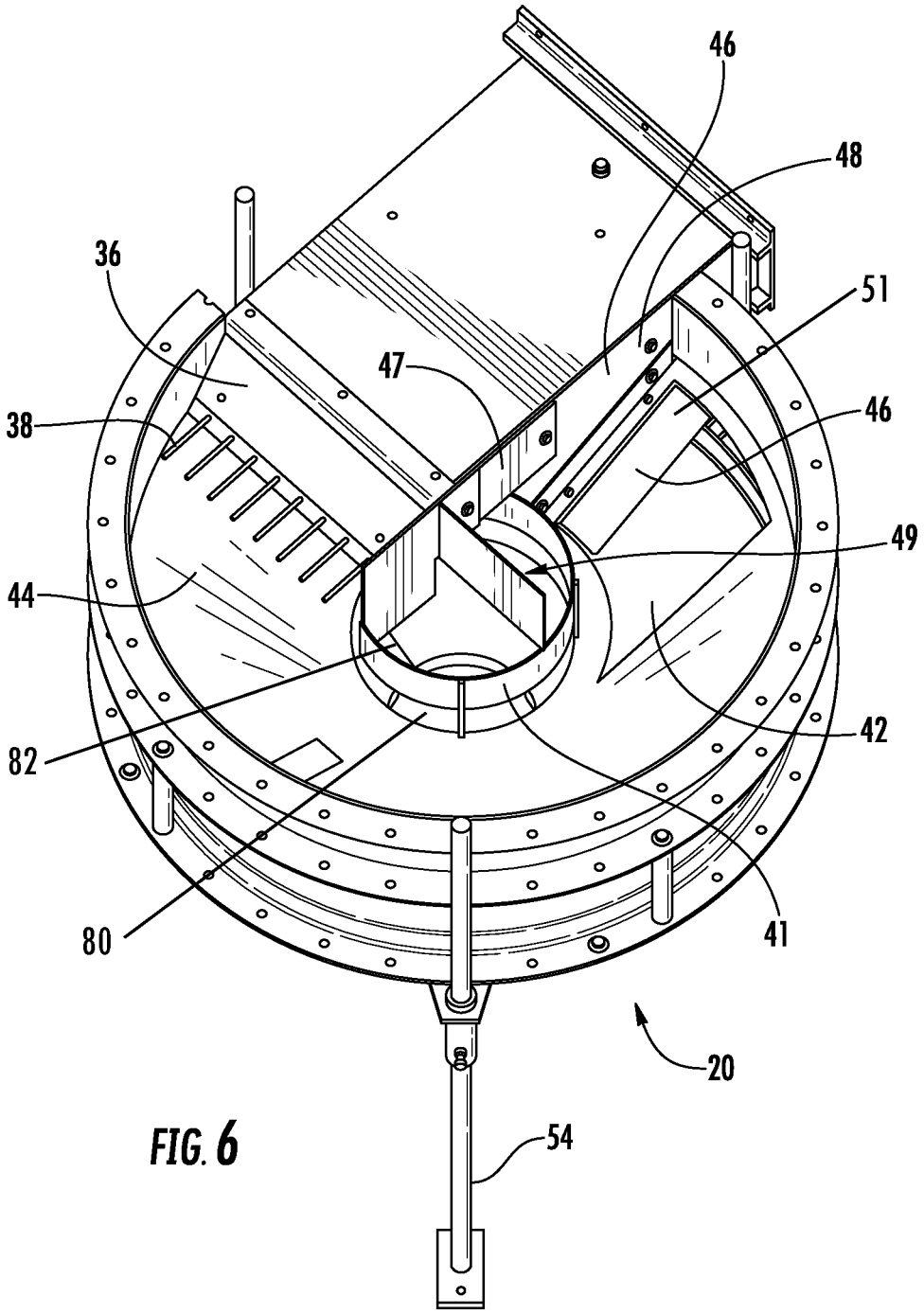
FIG. 6 is a perspective view of the chamber with the cover removed.

Now referring to FIGS. 5 and 6, the specific flow of seeds and air through the drying chamber 20 are described. The conveyor 106 (shown in FIG. 7) or other means brings seeds or other materials to hopper 27 of the drying chamber 20. Preferably the hopper 27 has a series of walls 34 that give the hopper 27 a larger opening at the top and a smaller opening at the bottom to allow the seeds to be funneled into the first chamber 22. As the seeds fall into the first chamber 22 via gravity, they contact a seed deflector 36. The seed deflector 36 is angled, preferably at approximately forty five degrees, such that the seeds will be directed toward a plurality of deflector bars 38. The initial contact with the seed deflector 36 allows the seeds to better separate from one another. Additionally, a portion of the seeds will come in contact with one or more of the plurality of deflector bars 38, further separating the seeds from one another. Such separation allows a more consistent drying of the seeds.

As the seeds enter the first chamber 22, air enters the drying chamber 20, specifically the first chamber 22 via air intake 26. The air can be regulated for temperature prior to entering the drying chamber 20. A variety of known means including the use of a heater can be utilized to reach the desired air temperature. Similarly, an air pump can be utilized with the heater to achieve a desired air flow rate. Although, a reverse configuration can be utilized to direct the air and seed in a clockwise rotation through the drying chamber 20, the chamber 20 shown in the figures directs the air and seeds in a counterclockwise direction.

The seeds in the first chamber 22 are directed in the counterclockwise direction by the air flow. Additionally, an outer wall 40 and inner wall 41 assist in directing the seeds toward an opening 42 of a bottom wall 44 of the first chamber 22 and toward a series of deflectors 46. An angled deflector 51 is one of the series of deflectors 46 and is positioned atop a portion of the opening 42. The angled deflector 51 is beveled upwards toward the top of the first chamber 22 to assist in directing the seeds toward the second chamber 24. A majority of the seeds fall through the opening 42 and into the second chamber 24. A portion of the seeds will make contact with a first deflector 47 and/or a second deflector 48 before then falling through opening 42 and into the second chamber. Air is deflected in a similar manner as the seeds with a majority of the air being directed into the second chamber 24. A portion of the air will exit through vent 28 prior to entering the second chamber 24. An air baffle 49 assists in directing air to the second chamber 24.

The second chamber 24 is defined by a bottom 50, the vented chamber screen 30 and the bottom wall 44 of the first chamber 22. The vented chamber screen 30 allows air to exit at one or more selected locations, while prohibiting the seeds from exiting through the vented chamber screen 30. The bottom wall 50 is sloped from top to bottom in a conical shape and ends in the discharge outlet 32. The seeds, as well as a portion of the air then exit through the discharge outlet 32.

As the drying chamber 20 is used to at least partially dry the seeds, the amount of seeds being fed into the drying chamber 20 may cause the accumulation of seeds in the first chamber 22. In order to alleviate a certain amount of accumulation, slot 77 is in the bottom wall 44. As seeds accumulate, once the accumulation reaches slot 77, seeds will begin to fall through the slot 77 and be directed toward the second chamber 24. Additionally, inner wall 41 is positioned within the drying chamber 20 such that a gap 80 is formed between bottom wall 44 and the inner wall 41, also allowing excess seed to drop from the first chamber 22 toward second chamber 24. Similarly, a second gap 82 is located between inner wall 41 and the assembly cover 47 which allows excess seed to spill over inner wall 41 and be directed toward second chamber 24.

The drying chamber 20 is supported by support legs 54 which can be adjusted to modify the height of the drying chamber 20. The desired height can be achieved through the adjustment of one or more of the supporting legs 54 depending on the location. Additionally, the outer edge of the drying chamber 20 can be fitted with a plurality of holes such that the legs 54 can be attached to a plurality of positions along the perimeter of the drying chamber 20. The drying chamber can be configured for a quick set up or can be permanently installed depending on user needs. The stackability of the drying chamber also allows greater processing capacity and the compact circular design lends itself to a small footprint. Furthermore, a mechanical vibrator (not shown) can be connected to the drying chamber 20. The vibrations produced by the mechanical vibrator assist in separating the seeds while in the drying chamber 20, thus increasing the drying capacity of the drying chamber 20. A fastener 78 such as a pair of elastic cords assists in anchoring the chambers 22 and 24.

As shown in FIG. 7, the drying chamber 20 can be connected to the heater 102, blower 104 and the conveyor 106 to form the drying system 100. The heater 102 can be coupled with the blower 104 to continuously supply air at a particular temperature and air flow. In the embodiment shown in FIG. 7, a fan unit provides such means. Additionally, an ignition chamber is a means for heating the air. The heated air exits the heater 102 and then enters tubing 138. The temperature of the heated air can be monitored by a number of gauges and the temperature can be adjusted accordingly. In FIG. 7, the heat is generated by igniting liquid propane, although any heating means can be used.

The tubing 138 leads to the air intake 26 of the drying chamber 20. The tubing 138 is attached to an adapter 60 which is connected to an adapter plate 62 which is connected to an air supply transition 64. The supply transition 64 is connected to the air intake 26. It is to be understood that the air intake can comprise parts 60, 62 and 64 and the listed parts can be one or multiple parts. A second gauge can be mounted on the air intake 26 to measure the temperature. As air continuously enters the drying chamber 20, seeds drop from the conveyor 106 into the drying chamber 20 via hopper 27. The seeds can be placed on the conveyor 106 from an untreated seed storage container. After the seeds are placed on the conveyor 106 but prior to dropping into the drying chamber 20, the seed are treated with a specific liquid treatment. Such treatment can be applied by using an atomizer or other means for turning a substance into a fine spray including spray tips. It is also to be understood that there can be applications wherein the seeds are not treated until after exiting the drying chamber 20 or treated while the seeds are within the drying chamber 20. Once the seeds drop from the conveyor 142, the seeds follow the direction and process as described in paragraphs 14 to 19. After exiting the drying chamber 20 via discharge outlet 32, the seeds can fall on a second conveyor 142 or some other known means for transporting the seeds. The seeds can then be stored for future use.

In addition to temperature and air flow, another variable is the amount of seed placed on the first conveyor 106. The greater the amount of seeds may cause a need to increase temperature and adjust the air flow rate. Air flow speed can also be adjusted by manipulating the size and shape of the air intake 26. A fabric panel 79 can be placed loosely around the periphery of the drying chamber to assist in directing air exiting the drying chamber 20 toward the floor in order to avoid directing air and heat toward an operator of the system 100.

It is understood that electronic control panels can be utilized to control the air flow, temperature, conveyors and other aspects of the drying chamber 20 and system 100. Furthermore, smoke detectors and/or carbon monoxide detectors can be attached to the system such that an alarm triggers audio and visual alarm indicators and can automatically shut down the system 100.

Having thus described the invention in connection with the preferred embodiments thereof, it will be evident to those skilled in the art that various revisions can be made to the preferred embodiments described herein without departing from the spirit and scope of the invention. It is my intention, however, that all such revisions will be included within the scope of the following claims.

What is claimed is as follows:

1. A drying chamber for seeds, comprising:
a first chamber;
a second chamber;
the first chamber having a first opening wherein the seeds can enter the drying chamber;
the drying chamber having a discharge outlet wherein the seeds can exit the drying chamber;
an air intake directing air flow into the drying chamber wherein the seeds are moved within the drying chamber by the air flow;
the first chamber above the second chamber;
the first chamber in communication with the second chamber via a second opening;
the drying chamber has a vented chamber screen wherein air can exit the drying chamber;
the first chamber has an inner wall;
the first chamber has a bottom wall;
a gap formed between the inner wall and the bottom wall configured to allow accumulating seeds to fall from the first chamber to the second chamber;
a slot in the bottom wall configured to allow accumulating seeds to fall from the first chamber to the second chamber.

2. The drying chamber of claim 1, further comprising:
a plurality of deflector bars;
the plurality of deflector bars extending horizontally from an angled seed deflector.

3. The drying chamber of claim 2, further comprising:
a vent connected on the first chamber wherein a portion of the air flow escapes the drying chamber;
the vent extending upward from the first chamber.

4. The drying chamber of claim 2, wherein:
the first chamber has circular walls directing the air flow in a circular pattern.

5. The drying chamber of claim 4, wherein:
the second chamber has circular walls directing the air flow in a circular pattern.

6. A method of drying seed, comprising the steps of:
forcing heated air horizontally into a drying chamber;
directing seeds vertically into a first chamber of the drying chamber;

directing the seeds via the heated air into a second chamber;

providing a slot in a bottom of the first chamber configured to allow excess seeds to fall from the first chamber to the second chamber;

removing the seeds from the drying chamber;

using the heated air to direct the seeds around an interior perimeter of the drying chamber.

7. The method of claim 6, wherein:

the drying chamber comprises at least two subchambers.

8. The method of claim 7, wherein:

the first chamber is connected to the second chamber via an opening;

a series of deflectors direct the seeds from the first chamber to the second chamber.

9. The method of claim 8, wherein:

the first chamber and the second chamber have circular walls directing the heated air and the seeds in a circular pattern.

10. The method of claim 9, wherein:

the first chamber has a plurality of deflector bars to assist in separating the seeds.

11. A system for drying seeds, comprising:

a drying chamber;

a heater;

a blower;

wherein the heater raises the temperature of air from the blower which is then directed into the drying chamber;

the drying chamber comprises a first chamber and a second chamber in communication with one another;

the second chamber beneath the first chamber wherein the seeds enter the first chamber and then are directed toward the second chamber;

the first chamber and the second chamber generally circular wherein the seeds and the air are directed near a periphery of the first chamber and the second chamber;

a first opening between the first chamber and second chamber;

the first chamber has an inner wall;

the first chamber has a bottom wall;

a gap formed between the inner wall and the bottom wall configured to allow accumulating seeds to fall from the first chamber to the second chamber;

a slot in the bottom wall configured to allow accumulating seeds to fall from the first chamber to the second chamber.

12. The system of claim 11, further comprising:

a first conveyor bringing the seeds to the drying chamber.

13. The system of claim 12, wherein:

the drying chamber comprises a hopper;

wherein the seeds leave the first conveyor and enter the hopper.

14. The system of claim 13, wherein:

the drying chamber comprises a chamber vent screen wherein a majority of the air exits the drying chamber.

15. The system of claim 14, wherein:

the drying chamber comprises a vent wherein excess air can exit the drying chamber.

* * * * *